US007131622B2

(12) United States Patent
Davis

(10) Patent No.: US 7,131,622 B2
(45) **Date of Patent: *Nov. 7, 2006**

(54) CHRISTMAS TREE STAND

(76) Inventor: John H. Davis, 3796 Stewart Rd., Eugene, OR (US) 97402

( * ) Notice: Subject to any disclaimer, the term of this patent is extended or adjusted under 35 U.S.C. 154(b) by 0 days.

This patent is subject to a terminal disclaimer.

(21) Appl. No.: 11/100,975

(22) Filed: Apr. 7, 2005

(65) Prior Publication Data

US 2006/0226331 A1 Oct. 12, 2006

(51) Int. Cl.
*F16M 13/00* (2006.01)

(52) U.S. Cl. ..... 248/523; 248/511; 248/519

(58) Field of Classification Search ..... 248/519, 248/523, 524, 511, 528, 529; 47/40.5
See application file for complete search history.

(56) References Cited

U.S. PATENT DOCUMENTS 4,436,272 A * 3/1984 Lile et al. ..... 248/527
4,477,049 A * 10/1984 Davis ..... 248/524
4,901,971 A * 2/1990 Connelly ..... 248/523
4,920,592 A * 5/1990 Scott ..... 7/100
5,137,246 A * 8/1992 Idso ..... 248/523
5,522,177 A * 6/1996 Davis ..... 47/40.5
5,725,193 A * 3/1998 Adams ..... 248/523
5,738,329 A * 4/1998 Woodard ..... 248/523
6,883,270 B1 4/2005 Davis

* cited by examiner

*Primary Examiner*—Amy J. Sterling
(74) *Attorney, Agent, or Firm*—Olson & Olson

(57) ABSTRACT

The Christmas tree stand of this invention includes a lateral segment of the bottom end of a vertical post, and an upwardly projecting wedge adjacent the outer end of the lateral segment is arranged to penetrate the bottom end of a Christmas tree to secure the latter against lateral displacement relative to the post and against rotation about the axis of the tree. The wedge is formed as a triangular shaped member and is secured to the lateral extension of the post, as by welding.

4 Claims, 2 Drawing Sheets

CHRISTMAS TREE STAND

BACKGROUND OF THE INVENTION

This invention relates to Christmas tree stands, and more particularly to a Christmas tree stand having simplified means for supporting a Christmas tree in vertical position and against axial rotation.

This invention is an improvement over my earlier U.S. Pat. Nos. 5,522,177 and 4,477,049, and patent application Ser. No. 10/654,312, filed 3 Sep. 2003 and allowed 5 Nov. 2004, now Pat. No. 6,883,270. These prior disclosures are incorporated herein by reference.

The tree anchor disclosed in the U.S. Pat. No. 5,522,177 comprises a foot plate secured to and extending laterally from the bottom end of the vertical support, as by welding, and a rectangular wedge plate is secured at the corner of the foot plate and post, also as by welding. An opening in the foot plate laterally outward of the wedge plate freely receives a cylindrical pin. The bottom end of the tree abuts the foot plate and is first driven laterally to penetrate the wedge plate into the side of the tree. Thereafter, the cylindrical pin is inserted in the opening in the foot plate and then driven into the base end of the tree to secure the tree against lateral displacement.

In U.S. Pat. No. 4,477,049, an up-turned point extends upwardly from the outer end of a short horizontal portion of the bottom end of a vertical tree supporting post. The upturned point is driven into the base end of the tree, and a V-shaped bracket adjacent the upper end of the post forms a saddle to capture an upper portion of the tree. Openings in the V-shaped bracket receive nails which are driven into the side of the tree to secure it laterally and to prevent its rotation.

In the pending patent application aforesaid, the bottom end of a tree is secured by a wedge plate and pin, substantially in the same manner as the first patent discussed.

In my prior inventions discussed above, the structures for securing the base of a Christmas tree to a stand are complex assemblies of components requiring excessive manufacturing time and cost.

SUMMARY OF THE INVENTION

The Christmas tree stand of this invention incorporates many of the features of my earlier inventions and in addition provides a simplified tree base anchor in the form of a wedge extending upwardly from the laterally extending bottom portion of the vertical tree support post. In a preferred embodiment, the wedge is a triangular shaped member welded or otherwise secured to and extending upwardly from the laterally extending bottom portion of the vertical tree support post. The tree first is laid on its side and the vertical tree support post is placed against the outer side of the tree, and then the laterally extending bottom portion of the post is struck with a hammer to drive the wedge into the base end of the tree. The tree thus is secured to the supporting post against lateral displacement and the wedge shape secures the tree against axial rotation.

It is the principal objective of this invention to provide a Christmas tree stand having a simplified unitary tree base anchor which prevents both axial rotation and lateral displacement of a tree relative to the stand.

Another objective of this invention is the provision of a Christmas tree stand of the class described which is of simplified construction for economical manufacture and ease of installation on a tree.

The foregoing and other objects and advantages of this invention will appear from the following detailed description taken in connection with the accompanying drawings of preferred embodiments.

DESCRIPTION OF THE PREFERRED EMBODIMENTS

Figure 1:
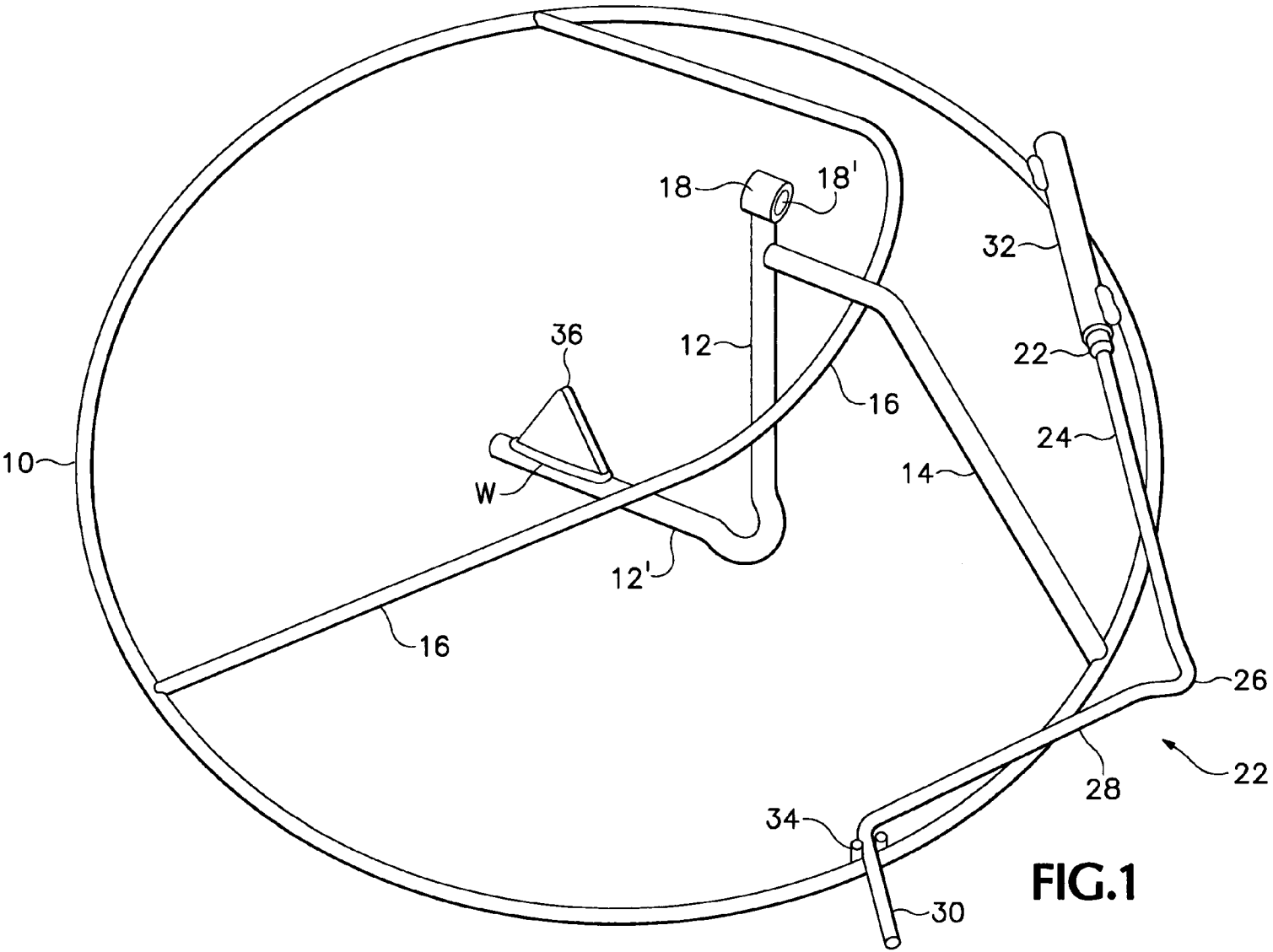
FIG. 1 is a perspective view of a Christmas tree stand embodying the features of this invention.

The Christmas tree stand of this invention includes several of the structural features of my earlier disclosures in U.S. Pat. Nos. 5,522,177 and 4,477,049 and pending patent application Ser. No. 10/654,312 filed 3 Sep. 2003 and allowed 5 Nov. 2004, all of these references are incorporated herein by reference. This invention provides a single, pointed wedge element associated with an elongated Christmas tree support post and configured to penetrate the bottom base end of a tree, in the central area thereof, to secure the tree against lateral displacement and axial rotation relative to the supporting post.

Briefly, the Christmas tree stand of this invention preferably includes a metal base ring 10 which supports an upright Christmas tree support post 12 by means of an angular support rod 14 secured at its lower end to the base ring and at its upper end to an intermediate point on the vertically extending tree support post 12. A U-shaped brace 16 is secured at its free ends to the base ring 10 and at its closed, intermediate end to the support rod 14.

The upper end of the post 12 preferably is terminated by a tube 18 which is provided with an axial bore 18' for the free reception of the threaded screw end 20' of a hand crank 20. The screw end of the crank has an adjacent enlarged abutment 22 which serves to abut the tube 18 at the upper end of the post 12, to enable the screw end 20' to enter the side of a Christmas tree T and draw it toward the post for vertical disposition. The angle between the vertical and horizontal portions 12 and 12', respectively, of the post is enlarged arcuately to insure that the base of the tree can abut the horizontal portion 12' at the bottom end of post 12 and thereby insure full penetration of the anchor wedge described hereinafter.

The crank 20 includes a screw crank segment 24 extending from the abutment 22 to an intermediate arcuate bend 26 configured with an enlarged radius to provide an anvil disposed in axial alignment with the crank segment 24 and screw 20'. A hammer thus may be impacted against the anvil to drive the screw into the side of a Christmas tree a short distance to set the screw into the tree.

A second segment 28 of the screw crank extends from the arcuate bend 26 to the handle end segment 30 for rotating the crank, to effect screwing the screw end 20' into the side of a tree until the abutment engages the post and draws the tree into vertical alignment with the post.

As disclosed in the patent application identified above, means is provided for securing the screw crank 20 releasably to the Christmas tree base ring 10 to retain the screw crank with the main body of the Christmas tree stand when not in use, as for multiple stacking for shipment to dealers and distributors and when the ultimate user stores the stand after the Christmas season has ended and the stand is removed from the tree. As illustrated, the screw crank retainer includes a tubular socket 32 welded or otherwise secured to the base ring for freely receiving the screw end 20' of the screw crank 20 with the abutment 22 engaging the open end of the socket. The socket is arranged so that the segments 24, 28, 30 of the screw crank traverse the base ring in a zig-zag pattern, for support thereon. A U-shaped retainer 34 is welded or otherwise secured to the ring in position for retaining the handle segment 30 of the screw crank. The retainer 34 is configured to receive the handle segment of the crank freely from above the base ring after the screw end 20' has been inserted in and captured by the retainer socket 32.

As mentioned previously, the present invention provides a simplified and economical securement of a Christmas tree T to the stand. Referring to the drawings, the horizontal lower segment 12' of the post 12 is arranged to support a triangular shaped wedge 36. The elongated base of the wedge is secured to the upper surface of the horizontal segment of the post, as by the welding W indicated. The pointed end of the wedge projects upwardly for penetration of the wedge into the base end of a tree.

As indicated in broken lines in FIG. 1, the wedge 36 is located horizontally outward from the post 12 so that the pointed end of the wedge is located slightly offset from the center of the tree base. Thus, trees of different heights and base diameters are accommodated by tree stands of different sizes, with the wedge 36 positioned at different distances outwardly of the confronting adjacent surface of the post. The offset of the wedge accommodates stacking of a plurality of the stands, as for shipment and storage.

Attachment of the tree stand of this invention to a Christmas tree is as follows: The tree is laid on its side and the appropriate sized stand is manipulated to place the tree stand post 12 against the side of the tree, with the pointed end of the wedge 36 engaging the bottom, base end of the tree. By applying hammering blows to the bottom side of the horizontal segment 12' of the post, the wedge is driven into the base of the tree. With the screw thread end 20' of the crank 20 positioned against the side of the tree, a hammering blow against the anvil 26 serves to set the screw thread into the tree. Thereupon, the handle end 30 of the screw crank 20 is rotated to draw the screw thread end 20' of the crank into the side of the tree. The abutment 24 adjacent the screw thread 16 serves to draw the tree toward the post for vertical disposition.

Figure 2:
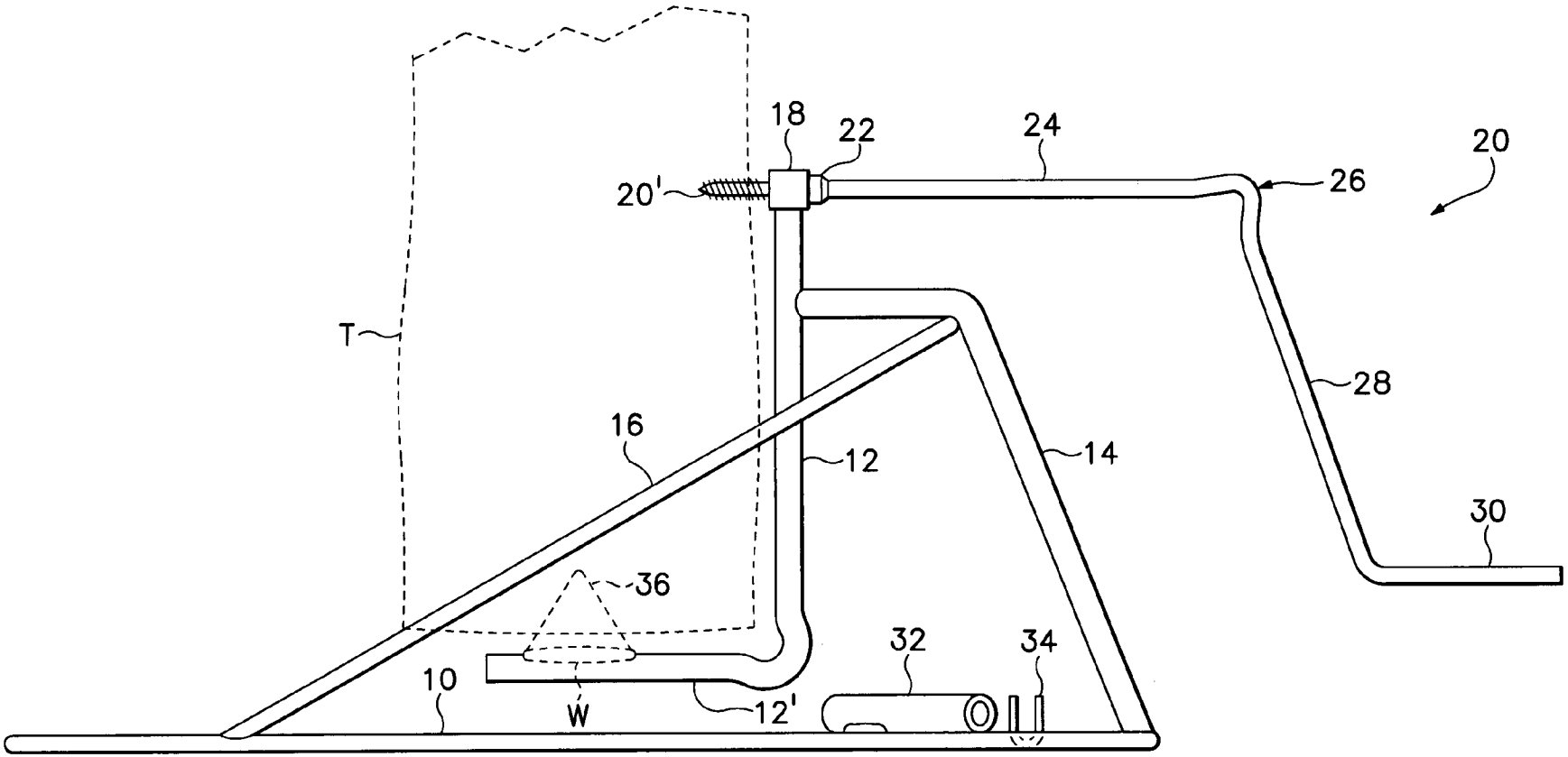
FIG. 2 is a side elevational view of the Christmas tree stand of FIG. 1 showing in broken lines a Christmas tree secured to the base anchor of this invention.

In the embodiment of FIGS. 1 and 2, the wedge 36 may be economically mass produced by successive stampings from a strip of metal, conveniently having a width equal to the height of the wedge, i.e. from the base to the point. For example, a strip of hot rolled flat stock of metal of one-eighth inch thickness and three-fourths inch width may be stamped or otherwise cut to produce a sequence of wedges each having a base of three-fourths inch and a heighth of three-fourths inch. A similar shape wedge having a base width of one inch and a height of one inch may be produced from a one-inch strip of metal. Other dimensions are available, as will be apparent.

It will be apparent to those skilled in the art that various modifications and changes to the structures described hereinbefore may be made without departing from the spirit of this invention and the scope of the appended claims.

I claim:

1. A Christmas tree stand comprising:

a) a base member, b) a tree supporting post supported on the base member and having one portion extending vertically upward therefrom, c) a tree base anchor portion extending laterally from a bottom end of the said one portion of the post, d) a wedge member supported on the tree base anchor portion and having a pointed end projecting upwardly therefrom for penetration into a base end of a tree, the wedge member securing a bottom end of a tree against lateral and rotational movement relative to the supporting post, e) a screw crank member having a screw thread segment at one end and a handle segment at the opposite end, an opening at an upper end of the said one portion of the post for removably receiving the screw thread segment of the crank member for releasably securing the side of a Christmas tree to the post, f) a socket member secured to the base member for removably receiving the screw thread segment of the crank member for storage, and g) a retainer member secured to the base member for removably receiving the handle segment of the screw crank member for storage.

2. The Christmas tree stand of claim 1 wherein a distance between the pointed end of the wedge member and an adjacent surface of said one portion of the post accommodates positioning the pointed end of the wedge member in a central area of a base end of a tree.

3. The Christmas tree stand of claim 1 wherein the wedge member is secured to the anchor portion of the post by welding.

4. The Christmas tree stand of claim 1 wherein an angle between the post and the laterally extending anchor portion is configured to allow the base end of a Christmas tree to rest on the anchor portion.

* * * * *